United States Patent [19]

Rossmann

[11] Patent Number: 4,534,245

[45] Date of Patent: Aug. 13, 1985

[54] TIGHT-GRIP WRENCH

[76] Inventor: William F. Rossmann, 2431 Highwood Dr., McHenry, Ill. 60050

[21] Appl. No.: 553,408

[22] Filed: Nov. 21, 1983

[51] Int. Cl.[3] ..... B25B 13/28

[52] U.S. Cl. ..... 81/90.1; 81/111

[58] Field of Search ..... 81/91 R, 91 A, 91 B, 81/91 C, 111, 117

[56] References Cited

U.S. PATENT DOCUMENTS

| | | | |
|---|---|---|---|
| 531,125 | 12/1894 | Lind . | |
| 592,036 | 10/1897 | Woods . | |
| 672,532 | 4/1901 | Kaley | 81/91 B |
| 794,597 | 7/1905 | Dunham et al. . | |
| 824,082 | 6/1906 | Reynolds . | |
| 877,225 | 1/1908 | Paterson . | |
| 1,174,907 | 3/1916 | Stickles et al. . | |
| 1,183,371 | 5/1916 | Ginsburg . | |
| 1,204,383 | 11/1916 | Spanier . | |
| 1,718,719 | 6/1929 | Turner . | |
| 2,646,709 | 7/1953 | Daniels | 81/91 B |
| 3,309,949 | 3/1967 | Neff | 81/111 |
| 3,358,532 | 12/1967 | Allred | 81/111 |
| 4,130,032 | 12/1978 | Giandomenico et al. | 81/119 |

*Primary Examiner*—James L. Jones, Jr.

*Attorney, Agent, or Firm*—Mathew R. P. Perrone, Jr.

[57] ABSTRACT

A tight-grip wrench has attributes of both a closed-end wrench and an open end wrench by having a handle which moves a large jaw relative to a small jaw.

9 Claims, 3 Drawing Figures

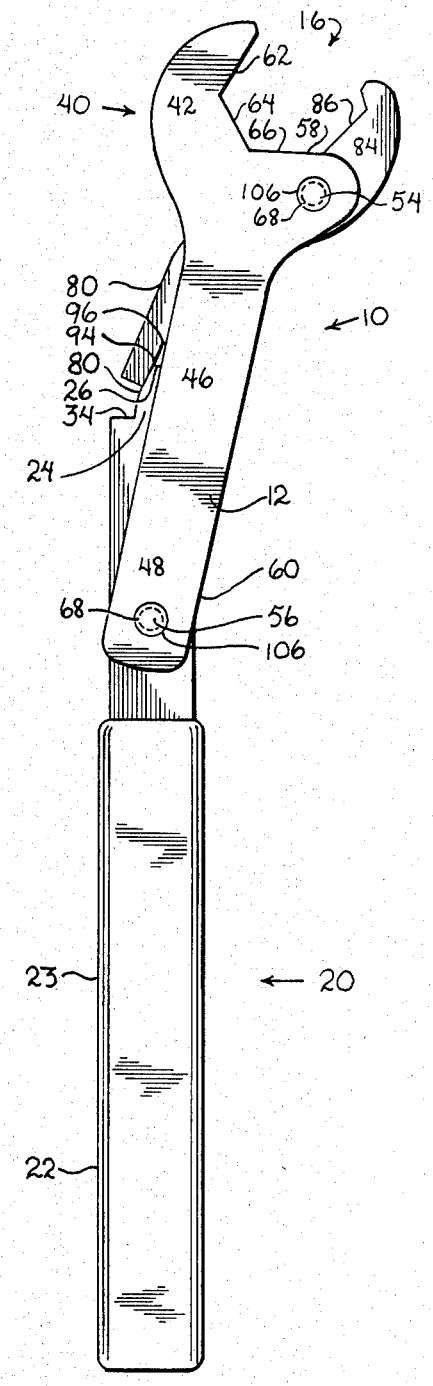
Fig. I
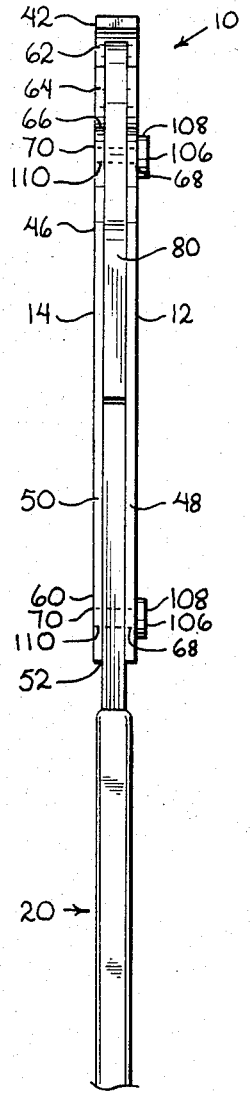
Fig. II
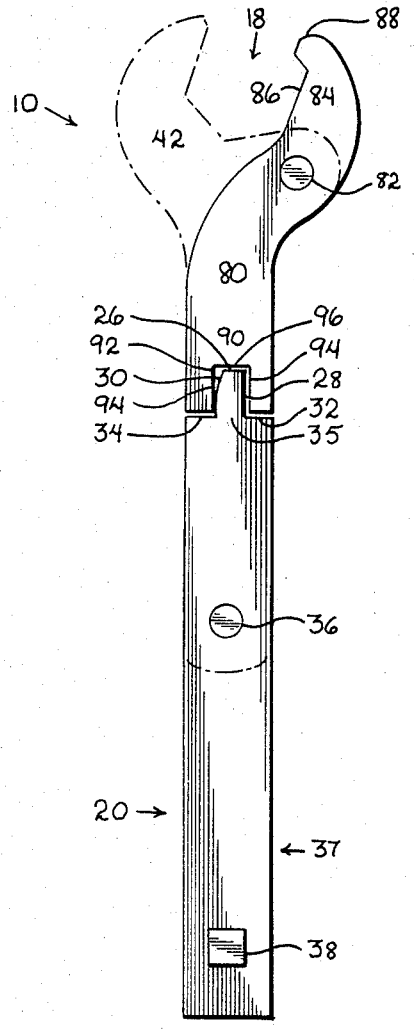
Fig. III

TIGHT-GRIP WRENCH

BACKGROUND OF THE INVENTION

This invention relates to a wrench and more particularly to an open-end wrench having the gripping capability of box end wrench or flare nut wrench combined with the flexibility of a ratchet wrench in one wrench.

The classes of wrenches including open end wrenches, box or closed end wrenches, flare nut wrenches, spanner or adjustable wrenches, and ratchet wrenches are extremely useful in certain areas. However, there are some areas where the design of the particular class of wrench precludes its use. For example, an open end wrench can have access to many nuts, which other classes of wrenches cannot reach or, on which, the other classes cannot be used.

Yet this access feature of the open end wrench causes other problems. The normal open end wrench has only two points of contact with the hex nut or bolt head. If the nut or bolt turns with considerable resistance, the normal open end wrench can slip and round the points off of the nut or bolt head. The box end wrench provides six or twelve point gripping for a nut—thereby minimizing or eliminating the change of slipping or rounding off the points.

The mixture of English-sized nuts and metric-sized nuts used today causes additional problems. The open end or fixed end wrench must be precisely sized to fit the nut or bolthead. This causes problems because the closeness of size between certain metric and English sizes is sufficiently different to require different fixed wrenches. It is desirable to have a wrench with closed end capabilities also to have the capability of fitting closely-sized English or metric nuts.

There are cases where a bolt head or a nut is partially covered by an object or blocked in another fashion, which makes it impossible to place a box end thereover. Also, there are also situations a nut is on a threaded rod protected by brackets or other devices on each end of the rod which do not allow a box end wrench to be placed over the nut. An open end wrench, with all of its inherent disadvantages must be used in these cases.

A disadvantage of both the open end wrench and closed end wrench (a generic name for open and closed end wrenches being fixed end wrenches) becomes apparent, when a fixed end wrench is used on a worn nut or bolt, or a nut or bolt with a slight size variation as occasionally occur during manufacture. Such variations, whether caused by wear or manufacturing differences, can render the use of the fixed end wrench impossible.

Additionally rusted or frozen nuts usually cannot be loosened by the standard open end wrench. The normal open end wrench, with its two point gripping power, can slip and round off the points of the nut or bolt head. This increased damage adds to the problems of removing the nut.

There are problems with the use of a flare nut wrench too, even though a flare nut wrench can provide more gripping points when used in a proper fashion than can an open end wrench. If the flare nut or fitting turns hard, the flare nut wrench is a very time-consuming tool to use. A ratchet wrench can simplify this problem, but a ratchet wrench has no access to a flare nut.

It thus becomes clear that it is advantageous to combine features of the open end wrench with features of the other wrenches to achieve very desirable results.

SUMMARY OF THE INVENTION

Therefore, it is an object of this invention to provide a tight-grip wrench having increased contact with a nut or bolt head.

A further object of this invention to provide a tight-grip wrench suitable for use on a metric-sized nut which is close to the size of an English-sized nut.

A still further object of this invention is to provide a tight-grip wrench suitable for reaching an at least partially blocked nut or bolt head.

Yet a further object of this invention is to provide a tight-grip wrench suitable for loosening rusted or frozen nuts.

Also, an object of this invention is to provide a tight-grip wrench capable of having increased gripping potential.

Another object of this invention is to provide a tight-grip wrench having an open end, yet being capable of duplicating features of a ratchet wrench.

Yet another object of this invention is to provide a tight-grip wrench having an open end, yet being capable of duplicating features of a box or closed end wrench.

Still another object of this invention is to provide a tight-grip wrench having an open end, yet being capable of duplicating features of a spanner or adjustable wrench.

A further object of this invention to provide a tight-grip wrench suitable for use on a worn nut or bolt head.

These and other objects of this invention (which other objects become clear upon consideration of the specification as a whole) are met by providing a tight-grip wrench capable of achieveing more contact with a nut, bolt head, or pipe than can be achieved by an open end wrench, the tight-grip wrench being opearted by action of the handle and held by force applied—whether used in a tightening or loosening mode.

BRIEF DESCRIPTION OF THE DRAWING

FIG. I is a view of tight-grip wrench 10 from top side 12 in open position 16.

FIG. II is a edge view of tight-grip wrench 10.

FIG. III is a view of tight-grip wrench 10 from top side 12 with large jaw 40 removed.

Throughout the figures of the Drawing, where the same part appears in more than one figure, the same number is given to that part.

DESCRIPTION OF THE PREFERRED EMBODIMENTS

A tight-grip wrench is moved to a closed position to hold a nut, a pipe, or other item desired to be held by action of the handle in relation to an opposed pair of movable, and is moved to a open position to release the nut, the pipe, or other item desired to be held. The wrench is preferrably made of metal. However, other materials having the appropriate strength are also operable.

The main objective of this invention is to provide a tool which can be used as an open end wrench and still provide the grip of a box end wrench. The tight-grip wrench of this invention provides more than the two point grip of the standard open end wrench. The tight grip wrench is a tool which can be used as an open end wrench and still provide the grip of a closed end wrench.

Another reason for the great utility of the wrench of this invention is that with one tool, the advantages of an open end wrench, a box end wrench, a flare nut wrench, and a ratchet wrench are achieved all in one wrench. It is the only wrench with which a person can remove a frozen or over tightened petcock or drain cock from an engine or a radiator without destroying the petcock or drain cock, damaging the engine or radiator. By using the same general type of mechanism design, and changing the configuration of the jaws, it is possible to grip other shapes. Typical of these other shapes are square or spline shapes. It can even be used as a spanner wrench but it can have a positive closing action, which a spanner wrench does not have.

Referring now to FIG. I, tight-grip wrench 10 is shown with top side 12 exposed and bottom side 14 down (bottom side 14 being shown in FIG. II) in open position 16. Open position 16 permits wrench 10 to fit onto the nut or bolthead, on which a person desires to use wrench 10. Closed position 18 (shown in dashed lines in FIG. III) indicates the smallest nut or bolt head around which wrench 10 fits.

Handle 20 as shown in FIG. I, FIG. II and FIG. III, has a grip 22 at one end thereof and a tip 24 at the other end thereof. Grip 22 is the section on which a user of the wrench can place a hand in order to operate the wrench 10. A grip cover 23 may optionally be applied to grip 22 for decorative, protective, or other purposes. For example, in electrical uses, grip cover 23 may serve an insulative purpose.

Tip 24 is at the end of handle 20 opposed to grip 22. The structure of tip 24 is an essential feature of the operation of wrench 10. At the extreme endpoint of handle 20 and tip 24 is flat top 26. Substantially perpendicular to flat top 26 is flat side 28. Both flat top 26 and flat side 28 are substantially straight.

Oppositely disposed from flat side 28 is arced side 30. Arc side 30 is indeed arced downwardly from flat top 26. Arc side 30 combines with base notch 92 in small jaw 80 to provide a flexibility of wrench 10.

Substantially perpendicular to flat side 28 and substantially parallel to flat top 26 is straight shoulder 32. Arced shoulder 34 is similar to straight shoulder 32, but oppositely disposed therefrom and on substantially the same straight line. Tip base 35 is an imaginary line drawn on handle 20 connecting straight shoulder 32 and arced shoulder 34. This line consisting straight shoulder 32, arced shoulder 34, and tip base 35 forms an arbitrary division between grip 22 and tip 24.

A modification of the tight grip wrench 10 is shown in FIG. III by shortening handle 20 to ratchet handle 37 and providing a ratchet receiver 38 therein for the purpose of the insertion of a drive extension or ratchet (not shown) therein. In this manner, a crow foot five point open end ratchet wrench is formed.

Referring now to FIG. I and FIG. II, large jaw 40 has a solid section 42 and slotted section 46. Slotted section 46 has a first member 48 which is shown when viewing topside 12 and a second member 50 which is shown when viewing bottom side 14. First member 48 and second member 50 form section slot 52 for receiving handle 20 and small jaw 80. Within slotted section 46 is first jaw aperture 54 and second jaw aperture 56. First jaw aperture 54 is adjacent solid section 42 and is included in slot top 58 of large jaw 40. Second jaw aperture 56 is adjacent slot base 60 and oppositely disposed from first jaw aperture 54. Slot top 58 is adjacent solid section 42. Slot base 60 is oppositely disposed therefrom.

At solid section 42 is first fixed nut contact 62. Adjacent first fixed nut contact 62 is second fixed nut contact 64 at approximately a 120 degree angle therewith. Adjacent second fixed nut contact 64 is slotted nut contact 66 at approximately a 120 degree angle therewith. Slotted nut contact 66 is formed by a mixture of solid section 42 and slot top 58. The slot top 58 part of slotted nut contact 66 also contains part of solid section 42. First fixed nut contact 62, second fixed nut contact 64, and slotted nut contact 66 form three sides, which serve a purpose similar to that of three sides of a substantially hexagonally shaped, fixed open end wrench well-known in the art.

Both first jaw aperture 54 and second jaw aperture 56 include a first opening 68 exposed when viewing topside 12 and a threaded opening 70 exposed when viewing bottomside 14. First opening 68 and threaded opening 70 have a common central axis. In this manner, large jaw 40 can cooperate with small jaw 80 to function as wrench 10.

Small jaw 80 (most clearly shown in FIG. III) includes a small jaw aperture 82 within nut gripper 84. Nut gripper 84 includes flat nut contact 86 adjacent nobbed nut contact 88. Nobbed nut contact 88 is at the tip of small jaw 80. Flat nut contact 86 and nobbed nut contact 88 on small jaw 80 cooperate with first fixed nut contact 62, second fixed nut contact 64 and slotted nut contact 66 to form the contact base for greater contact with the nut, bolthead, pipe or other item on which tight-grip wrench 10 is being used than can be obtained with the two-point contact of an open-end wrench.

Opposite nut gripper 84 on small jaw 80 is small jaw base 90. Within small jaw base 90 is base notch 92. Base notch 92 includes a pair of substantially parallel notch sides 94 substantially perpendicular to notch bottom 96. Base notch 92 receives tip 24 therein. Base notch 92 combines with tip 24 and arced side 30 to achieve a desired ratchet effect.

This combination of large jaw 40 and small jaw 80, resulting in increased nut or bolthead contact for the wrench 10, provides a combination of the advantages of both an open-end wrench and a box- (or closed-) end wrench. An open-end wrench offers only two points of contact with a nut or bolthead. A preferred contact for tight-grip wrench 10 is at least three-point contact. The most preferred contact for tight-grip wrench 10 is the five-point contact. This five-point contact is substantially equivalent to the six-point or twelve-point contact of a closed end wrench. As is above set forth, an open-end wrench provides more access to a nut, while a box-end provides better nut contact for tightening or loosening. Thus the combination of advantages with the ratchet effect, the five-point grip, and the access of the open end wrench in the tight-grip wrench 10 becomes clear.

To assemble wrench 10, tip 24 is inserted into base notch 92. Large jaw 40 is inserted over both handle 20 and small jaw 80 so that first member 48 of slotted section 46 and first openings 68 appear when viewing topside 12. Second member 50 and threaded openings 70 appear when viewing bottomside 14. Thus part of handle 20, all of tip 24, and most of small jaw 80 are within slot 52.

First jaw aperture 54 is alignable with small jaw aperture 82 for the purpose of receiving screw 106. Screw 106 is shown as removed from FIG. I but in FIG. II. For purely definitional purposes, topside 12 is defined as the side showing head 108. The head 108 of screw 106 appears on topside 12 while the threads 110 threadably engage threaded opening 70 of first jaw aperture 54 to thereby movably position small jaw 80 within slotted section 52 of large jaw 40.

Second jaw aperture 56 is alignable with handle aperture 36 for the purpose of receiving screw 106. The head 108 of screw 106 appears on topside 12 while the threads 110 threadably engage threaded opening 72 of second jaw aperture 56 to thereby position handle 20 within slotted section 52 of large jaw 20.

Due to notch sides 94 of small jaw 80 being substantially the same length as straight side 28 of handle 20 and tip 24 substantially filling base notch 92, wrench 10 operates to solves the designated problems of the art. Arced side 30 cooperates with its adjacent notch side 94 to move small jaw 80 in a restricted fashion about first jaw aperture 54 due to the presence of screw 106. Similarly, handle 20 moves about second jaw aperture 56 due to the presence of screw 106.

Thus, assuming bottom side 14 is facing the user of wrench 10, wrench 10 moves to open position 16 when moved clockwise and thereby receives or releases the item on which wrench 10 is being used. Similarly with bottom side 14 facing the user, movement of wrench 10 in a counterclockwise direction advances as close to closed position 18 as may be permitted by the item on which wrench 10 is being used.

If topside 12 is facing the user of wrench 10, wrench 10 moves to open position 16 when rotated counterclockwise, and closed position 18 when rotated clockwise.

Such movement to open position 16 and closed position 18 is accomplished by the interaction of handle 20 moving about screw 106 in handle aperture 36, and by interaction of arced side 30 and notch side 94.

Tip base 35 is of sufficient length so that tip 24 fits into base notch 92. The length of notch side 94 is substantially equal to that of straight side 28. Arced side 30 is formed because the length of flat top 26 is less than the length of tip base 35, with arced side 30 an end of flat top 26 to an end tip base 35.

The three major parts—large jaw 40, small jaw 80 and handle 20—may be connected in any suitable fashion, so long as the desired gripping and release actions are achieved. Any part hereof may be made of any suitable material. Metal of tool strength is preferred. Large jaw 40 may be machined or formed by lamination of two sheets on opposite sides of a flat piece of metal. Machining or molding are operable to make parts hereof too. Other methods are also operable for part forming.

Because of the disclosure herein and solely because of the disclosure herein, certain modifications of the tight-grip wrench 10 disclosed herein can become clear to a person having ordinary skill in this art. Such modifications are clearly covered hereby.

What is claimed and sought to be secured by Letters Patent of the United States, is:

1. A tight-grip wrench combining desirable features of an open-end wrench, a closed end wrench, a box end wrench, a flare nut wrench, and a ratchet wrench; said tight-grip wrench including a handle, a large jaw operatively secured to said handle, and a small jaw operatively secured to said large jaw and operable by action of said handle; wherein:

a. said handle includes a tip end and a grip end oppositely disposed from said tip end;
  (1) said grip end serving as a gripping place for the user of a wrench; and
  (2) said tip end having a tip operatively cooperating with said small jaw, said tip including;
    (a) a tip base situated between an arced shoulder, and a straight shoulder;
    (b) said tip base, said arced shoulder, and said straight shoulder being substantially colinear;
    (c) said tip protruding from said tip base;
    (d) said tip including a flat side;
    (e) said flat side being substantially perpendicular to said tip base, and between said straight shoulder and said tip base;
    (f) a flat top for said tip being substantially parallel to and oppositely disposed from said tip base;
    (g) said flat top being shorter than said tip base;
    (h) an arced side of said tip oppositely disposed from said flat side and connecting said flat top to the juncture of said arced shoulder and said tip base; and
    (i) a holding means adjacent said tip end for holding said handle in said wrench;

b. said large jaw has a solid section and slotted section;
  (1) said slotted section receiving said handle and said small jaw in an operative relationship; and
  (2) said slotted section including means for securing said handle to said large jaw and means for securing said small jaw to said large jaw;

c. said small jaw has:
  (1) a nut gripper;
  (2) a small jaw aperture within said nut gripper;
  (3) a nobbed nut contact on said nut gripper;
  (4) a flat nut contact adjacent said nobbed nut contact;
  (5) a small jaw base oppositely from said nut gripper on said small jaw;
  (6) a base notch within said small jaw base;
  (7) said tip of said handle being received in said base notch; and
  (8) said base notch having pair of substantially parallel sides;

whereby said arced side and said flat side cooperate with said base notch to move said wrench as desired between an open position and a closed position.

2. The tight-grip wrench of claim 1 wherein said grip end further includes a cover.

3. The tight-grip wrench of claim 1 wherein said handle further includes a ratchet receiver therein for the purpose of insertion of a drive extension or ratchet therein.

4. The tight-grip wrench of claim 1 wherein said large jaw further includes:

a. a topside for said slotted section;

b. a bottomside for said slotted section oppositely disposed from said topside; and c. a first jaw aperture and a second jaw aperture in said slotted section, said first jaw aperture being adjacent solid section and said second jaw aperture oppositely disposed from said first jaw aperture.

5. The tight-grip wrench of claim 4 wherein said solid section further includes a first fixed nut contact, a second fixed nut contact adjacent said first fixed nut contact, and a slotted nut contact adjacent said second fixed nut contact.

6. The tight-grip wrench of claim 5 wherein said first jaw aperture and said second jaw aperture include a first opening in said topside and a threaded opening in said bottomside; said first opening and said threaded opening having a common central axis.

7. The tight-grip wrench of claim 6 wherein said grip end further includes a cover.

8. The tight-grip wrench of claim 7 wherein said large jaw and said small jaw combine to provide five-point contact for a nut or a bolthead.

9. A tight-grip wrench combining desirable features of an open-end wrench, a closed end wrench, a box end wrench, a flare nut wrench, and a ratchet wrench; said tight-grip wrench including a handle, a large jaw operatively secured to said handle, and a small jaw operatively secured to said large jaw and operably by action of said handle; wherein:

a. said handle includes a tip end and a grip end oppositely disposed from said tip end;
   (1) said grip end serving as a gripping place for the user of a wrench; and
   (2) said tip end having a tip operatively cooperating with said small jaw;
   (3) a tip base on said tip end situated between an arced shoulder, and a straight shoulder;
   (4) said tip base, said arced shoulder, and said straight shoulder being substantially colinear;
   (5) said tip protruding from said tip base;
   (6) said tip including a flat side;
   (7) said flat side being substantially perpendicular to said tip base, and between said said straight shoulder and said tip base;
   (8) a flat top for said tip being substantially parallel to and oppositely disposed from said tip base;
   (9) said flat top being shorter than said tip base;
   (10) an arced side of said tip oppositely disposed from said flat side and connecting said flat top to the juncture of said arced shoulder and said tip base; and
   (11) a holding means for movably securing said handle in said wrench adjacent said tip end;

b. said large jaw has a solid section and slotted section;
   (1) said slotted section receiving said handle and said small jaw in an operative relationship; and
   (2) said slotted section including means for securing said handle to said large jaw and means for securing said small jaw to said large jaw;
   (3) a topside for said slotted section;
   (4) a bottomside for said slotted section oppositely disposed from said topside;
   (5) a first jaw aperture and a second jaw aperture in said slotted section, said first jaw aperture being adjacent solid section; and said second jaw aperture oppositely disposed from said first jaw aperture and capable of aligning with a handle aperture in said handle adjacent said tip; and
   (6) a first fixed nut contact on said solid section, a second fixed nut contact on said solid section and adjacent said first fixed nut contact at about a 120 degree angle therewith, and a slotted nut contact adjacent said second fixed nut contact at about a 120 degree angle therewith;

c. said small jaw has a nut gripper and a small jaw base oppositely disposed from said nut gripper;
   (1) a small jaw aperture within said nut gripper capable of aligning with said first jaw aperture;
   (2) a nobbed nut contact on said nut gripper; and
   (3) a flat nut contact adjacent said nobbed nut contact.
   (4) a base notch within said small jaw base;
   (5) said tip of said handle being received in said base notch; and
   (6) said base notch having a pair of substantially parallel sides— d. said large jaw and said small jaw combining to provide five-point contact for a nut or a bolthead on which said wrench is used;

e. said tip and said base notch combining to provide a ratchet type action and a gripping action for said wrench.

* * * * *